US006371024B1

(12) United States Patent
Scholzig et al.

(10) Patent No.: US 6,371,024 B1
(45) Date of Patent: Apr. 16, 2002

(54) SHEET-FED PRINTING MACHINE WITH CLEANING SYSTEM

(75) Inventors: Jurgen Scholzig, Mainz-Finthen; Uwe Puschel, Heidesheim; Ulrich Jung, Limburg, all of (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/693,806

(22) Filed: Oct. 20, 2000

(30) Foreign Application Priority Data

Oct. 20, 1999 (DE) ..... 299 18 488

(51) Int. Cl.[7] ..... B41F 35/00
(52) U.S. Cl. ..... 101/424; 101/425
(58) Field of Search ..... 101/424, 425, 101/423; 15/256.52, 256.51, 256.5; 399/350, 348, 344

(56) References Cited

U.S. PATENT DOCUMENTS

| | | | | |
|---|---|---|---|---|
| 4,615,293 A | * | 10/1986 | Jahn | 118/46 |
| 4,998,475 A | * | 3/1991 | John et al. | 101/366 |
| 5,121,689 A | | 6/1992 | Fadner | 101/365 |
| 5,410,961 A | * | 5/1995 | DeNicola et al. | 101/366 |
| 5,638,752 A | * | 6/1997 | Hartung et al. | 101/177 |

FOREIGN PATENT DOCUMENTS

| | | |
|---|---|---|
| DE | 3941571 A1 | 6/1990 |
| DE | 42 13 636 A1 | 10/1992 |
| DE | 41 21 017 C2 | 1/1993 |
| DE | 195 26 574 | 10/1996 |
| DE | 196 45 934 | 5/1998 |
| EP | 0 620 11 5 B1 | 3/1994 |

* cited by examiner

*Primary Examiner*—John S. Hilten
*Assistant Examiner*—Anthony H. Nguyen
(74) *Attorney, Agent, or Firm*—Leydig, Voit & Mayer, LTD.

(57) ABSTRACT

The invention relates to a sheet-fed rotary printing machine with printing units for multicolor printing and at least one coating unit. An object of the invention is to provide stable quality during the coating process and to reduce contamination of coating fluids. This is achieved by providing at least one coating unit being arranged downstream of the printing units, the coating unit including a cleaning system. More specifically, each of the coating units has a rotatable applicator roller, a metering system for applying coating fluid to the applicator roller, and a cleaning wiper system which is movable into and out of contact with the applicator roller. The cleaning wiper is arranged upstream of the metering system relative to a direction of rotation of the applicator roller.

16 Claims, 5 Drawing Sheets

SHEET-FED PRINTING MACHINE WITH CLEANING SYSTEM

FIELD OF THE INVENTION

The invention generally relates to a printing machine and more particularly relates to a sheet-fed rotary printing machine including at least one coating unit.

BACKGROUND OF THE INVENTION

Printing machines are known which have multiple coating units. For example, patent publication EP 0 620 115 B1, relates to a rotary printing machine having an in-line process for coating sheet printing materials, including at least two varnishing units provided as coating units. One of the varnishing units, which is upstream relative to the sheet transport direction, is constructed as a flexographic printing unit. The flexographic printing unit has a plate cylinder that bears a relief printing plate and is in contact with the sheet-carrying printing cylinder, an engraved applicator roller that is in contact with the plate cylinder for the purpose of inking or coating. Additionally, the printing unit includes a chamber-type coating doctor which can be moved into contact, and which is connected to delivery and suction pumps for the supply and return flow of coating liquid from the chamber.

In conventional previous printing machines, it has been found that the coating fluid can become undesirably contaminated, resulting in poor printing or quality fluctuations. This is especially problematic in sheet printing machines with printing units for multicolor printing and at least one coating unit, for example, a flexographic printing unit and/or a varnishing unit. As a result of excess or dried coating fluid accumulated on the applicator rollers, the print quality undesirably fluctuates or is impaired as early as during the coating process.

Attempts have been made in conventional printing machines to reduce undesired coating fluid from the applicator roller. For example, German patent publication DE 195 26 574 C1 discloses a system for cleaning a plate cylinder and an applicator roller, whereby the drying of rapidly drying media onto the applicator roller and onto the plate cylinder is reduced. The washing apparatus has two curved surfaces which face the applicator roller and the plate cylinder.

Also, German patent publication DE 196 45 934 A1 relates to an engraved applicator roller having dimples which can be filled with a liquifiable substance as a gravure printing plate. By means of an ultrasonic cleaning system, the plate can be regenerated to a basic pattern of the dimples.

German patent publication DE 41 21 017 C2 relates to a printer cleaning apparatus having a soft, smooth rubber-coated roller and an associated stripper roller with a polygonal cross section. In order to remove printing ink from the cover of the stripper roller, an ultrasonic cleaning device is provided.

A chamber-type wiper metering system is generally disclosed by U.S. Pat. No. 5,121,689. In this case, the metering system includes a working wiper coupled to an ultrasonic device in order to meter the layer thickness of printing ink on the metering roll.

A need exists for an improved printing machine which provides improved print quality. A further need exists for an improved means of cleaning of coating fluid from the applicator rollers therein.

OBJECTS AND SUMMARY OF THE INVENTION

It is an object of the invention to provide an improved sheet-fed rotary printing machine. Another object of the invention is to provide stable, consistent print quality. Still another object of the invention is to reduce undesired build up of ink or coating fluid residues on rollers in a printing system.

The present invention achieves these objects and avoids the aforementioned disadvantages. Advantageously, a system according to the present invention provides stable quality during the coating process and noticeably reduces the contamination of coating fluid.

An advantage of the present invention is that it provides, in association with a metering system, a means for cleaning the applicator roller continuously or selectively, thereby reducing contamination. The invention may be used with a variety of structures. For example, the invention may be alternatively used with a smooth applicator roller instead of an engraved applicator roller (with dimples and webs).

A further advantage of the present invention is that it especially improves quality in systems having multiple printing units. In particular, a problem with conventional printing machines having multiple printing units, a splitting back of ink (flexographic and/or offset printing ink from the preceding printing process) from the printing material into the metering system would undesirably occur, particularly in the metering system of the first coating unit. This splitting-back of ink results from the printing process in the printing units arranged upstream in the conveying direction. For example, when a chamber-type wiper is used with an engraved applicator roller, residues of ink, varnish, etc. can be eliminated. Otherwise, such residues may accumulate in the interior of the chamber-type wiper and/or on the applicator roller, and thereby undesirably mix with coating fluid. The present invention avoids such an undesired splitting-back effect by cleaning the applicator roller.

Moreover, in printing systems wherein dual-roll units are used (based on the squeeze-roll principle, with a nip formed between the rolls), the present invention can be used to reduce the accumulation of ink residue in the nip formed by the metering roll and/or the applicator rollers. This likewise applies to metering systems based on the dip-roll principle. In this case, the contamination of the holding container, of the roll train and/or of the applicator roller can be avoided.

A further advantage of the present invention is to provide a cleaning system which reduces the number of cleaning intervals for the respective metering system with applicator roller.

Additional features and advantages of the present invention are described in, and will be apparent from, the description figures and claims herein.

BRIEF DESCRIPTION OF THE DRAWINGS

FIG. 2 is a view of a coating unit having a chamber type metering wiper and a cleaning wiper positioned opposite each other relative to an associated applicator roller;

FIG. 3 is a view of a coating unit having a chamber type metering wiper and a cleaning wiper provided in an integrated structure relative;

FIG. 4 is a view of a coating unit having a chamber type metering wiper and a cleaning wiper positioned adjacent to each other; and FIG. 5 is a view of a coating unit having a chamber type metering wiper and a cleaning wiper are separately positioned at an angle relative to the associated applicator roller.

DETAILED DESCRIPTION OF THE DRAWINGS

Figure 1:
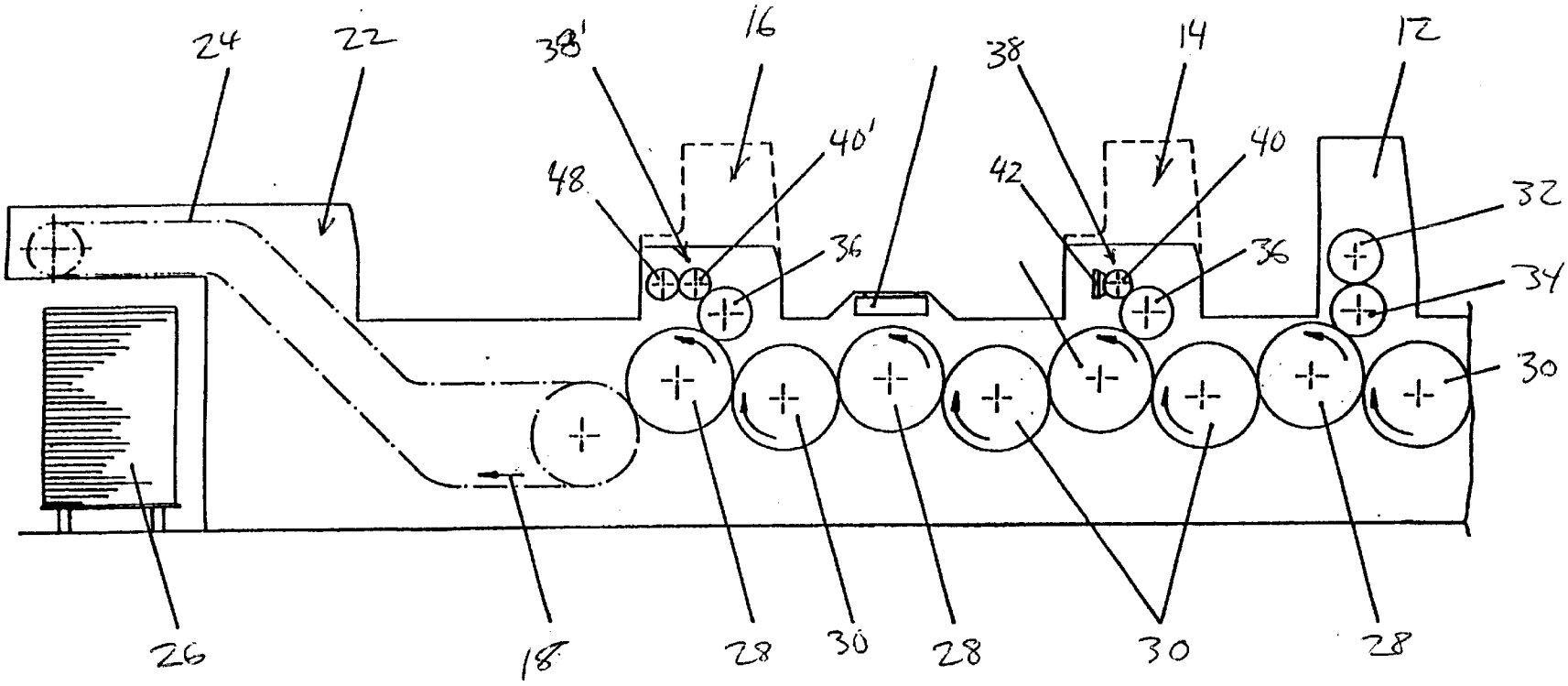
FIG. 1 is a diagrammatic side view of a sheet-fed rotary printing machine for multicolor printing with two coating units.

Now referring to the drawings, wherein like numerals designate like components, FIG. 1 illustrates a printing machine 10 constructed with a number of printing units 12 for multicolor printing, preferably offset printing units, in an in-line configuration. The printing machine 10 includes a first coating device 14 and a second coating device 16 arranged sequentially downstream of the printing units 12 relative to a conveying direction 18 along which sheet printing materials are transported.

For drying the sheet materials between stages, the printing machine 10 may include a dryer unit 20 positioned between the first and second coating devices 14, 16. Downstream end of the second coating device 16, the printing machine 10 further includes a delivery apparatus 22 for depositing output quantities of printed materials. For example, in the illustrated example, the delivery apparatus 22 includes a circulating conveyor system 24 for depositing the sheets onto a stack 26.

To transport the sheets during processing, the printing machine 10 includes a plurality of sheet-carrying impression cylinders 28 and transfer cylinders 30. The impression cylinders 28 and transfer cylinders 30 are arranged in series and rotatably driven by an appropriate mechanism to transport the sheet materials through the printing machine 10 generally along the conveying direction 18. Specifically, the cylinders 28, 30 carry the sheets sequentially among the printing units 12 and coating units 14, 16 for processing.

As shown in FIG. 1, each of the printing units 12 generally includes a plate cylinder 32, one of the impression cylinders 28, and a blanket cylinder 34 positioned between the plate cylinder 32 and impression cylinder 28. It will be understood by one skilled in the art that each of the plate cylinders 32 operates with a corresponding inking unit and, in some embodiments, a damping unit. At least one of the transfer cylinders 30 is positioned between adjacent stations of the printing units 12, coating units 14, 16 and drying unit 20. Also, the impression cylinders 28 and transfer cylinders 30 are designed to be twice the size of a single-size blanket cylinder 34 or plate cylinder 32.

In the exemplary printing machine 10 of FIG. 1, the first coating unit 14 is constructed as a varnishing unit. The coating unit 14 is adapted, for example, to apply processing emulsion varnish with pigments on an aqueous basis. More specifically, the illustrated coating unit 14 includes a sheet-carrying impression cylinder 28, a plate cylinder 36 which is selectively movable into and out of contact with the impression cylinder 28 and bears a flexible relief printing plate as a varnishing plate. Additionally, the coating unit 14 includes a first metering system 38. The first metering system 38 has an applicator roller 40 which may be engraved (e.g., with dimples and webs), and a chamber-type metering wiper 42 mounted in functional contact against the applicator roller 40. The applicator roller 40 is selectively movable into and out of contact with the plate cylinder 36, Still referring to FIG. 1, the second coating unit 16 is also constructed as a varnishing unit to, for example, apply processing emulsion lacquer on an aqueous basis. The second coating unit 16 also includes a sheet-carrying impression cylinder 28, a plate cylinder 36 which bears a rubber blanket and which is selectively movable into and out of contact with the impression cylinder 28. The second coating unit 16 has a second metering system 38'. For exemplary purposes, the second metering system 38' is illustrated as including an applicator roller 40' and a metering roller 48 with a common nip. In an embodiment, the applicator roller 40' may have a smooth surface. The applicator roller 40' is selectively movable into and out of contact with the plate cylinder 36. It will be appreciated that the invention may be implemented with various types of metering systems, including, but not limited to the types of metering systems 38 and 38' described herein.

Figure 2:
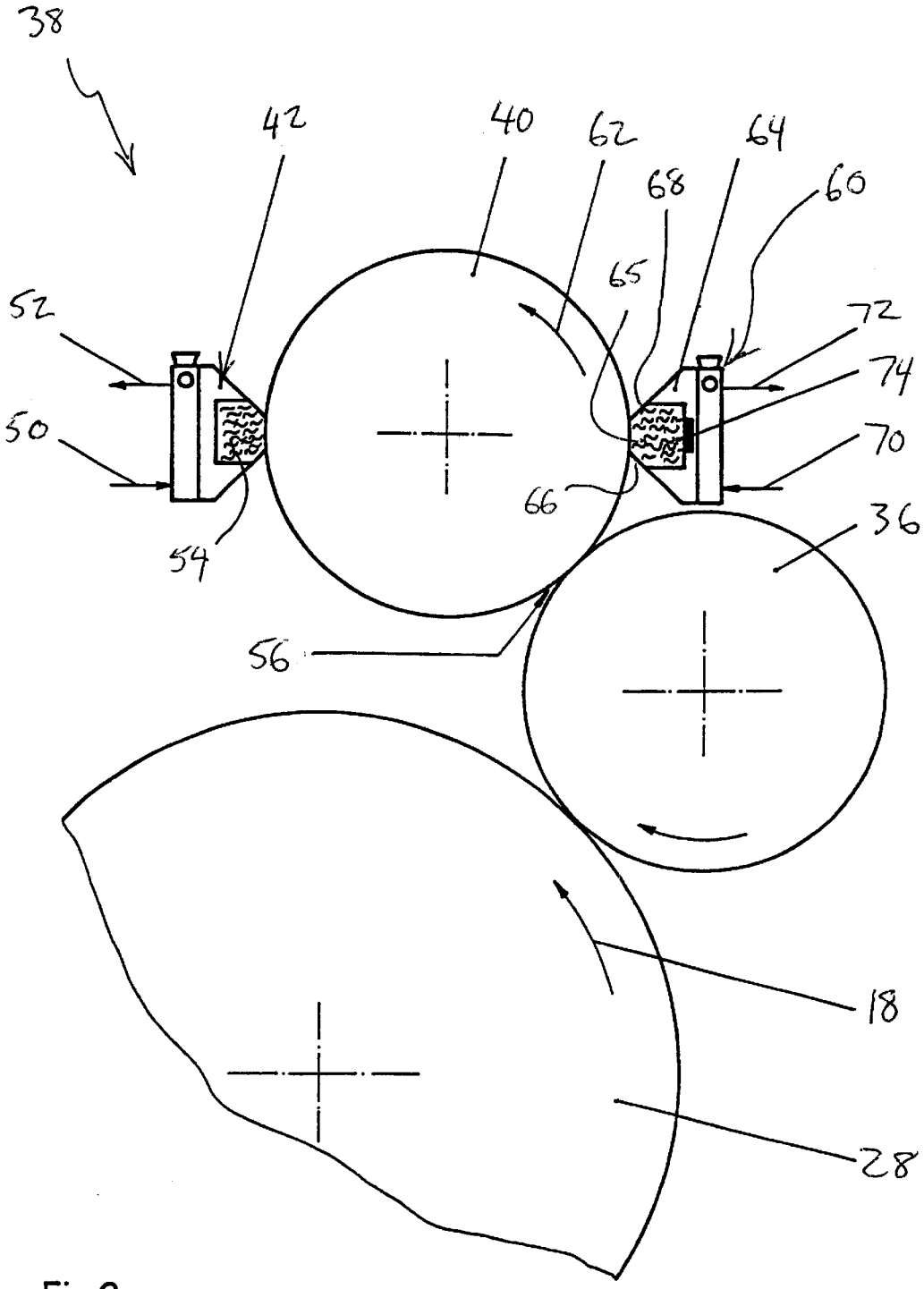
FIGS. 2–5 are enlarged, fragmentary diagrammatic views of the printing machine of particularly illustrating a coating unit according to various embodiments of the invention. In particular.

More particularly, turning to FIG. 2, an embodiment of the first coating unit 14 is illustrated in greater detail. In order to provide a fluid supply, the metering system 38 is in communication with a fluid conduit system having a feed line 50 and return line 52 for circulating a liquid coating medium or cleaning fluid. Specifically, in the case of the metering wiper 42, the feed line 50 and the return line 52 circulate fluid through the interior chamber 54 of metering wiper 42 which is contained by wiper blades so that the fluid in the chamber 54 contacts the applicator roller 40. It will be understood that in the case of a two-roll unit (squeeze-roll principle), such as the coating unit 16 and metering system 38' shown and described in connection with FIG. 1, the feed line opens above the nip that is jointly formed, and the return line is led off at the end of the nip, thereby applying fluid to the applicator roller in a metered fashion. Alternatively, in the case of a metering system of a type that operates on a generally known dip-roll principle, the feed line opens on the dip roll or in a container, and the return line is led off from the container.

To selectively operate the coating units, in each of the coating units 14, 16, the respective applicator roller 40, 46 is movable relative to the corresponding plate cylinder 36 between a first position wherein the applicator roller 40, 46 contacts the plate cylinder 36 and a second position wherein the applicator roller 40, 46 is spaced m the plate cylinder 36 by a gap 56. For desired processing, each of the fi and second coating units 14, 16 are arranged downstream of the printing units 12.

According to an aspect of the invention, each of the coating units includes a cleaning device adapted to remove undesired residue from the applicator roller. More specifically, the cleaning device is arranged upstream of the metering system relative to a rotation direction of the applicator roller, thereby preventing the residue from contaminating the coating fluid of the metering system. In an exemplary embodiment, the cleaning device is constructed as a chamber type doctor.

Furthermore, according to an aspect of the invention, each of the coating units 14, 16 includes a chamber type doctor referred to herein as cleaning wiper 60, corresponding to the respective applicator roller 40, 46 as illustrated for example in FIG. 2. The cleaning wiper 60 is selectively movable into and out of contact with the applicator roller 40. According to the invention, the cleaning wiper 60 is positioned upstream of the respective metering system 38 relative to a direction of rotation 62 of the applicator roller 40, and downstream of the gap 56 or point of contact between the applicator roller 40 and the plate cylinder 36.

Figure 3:
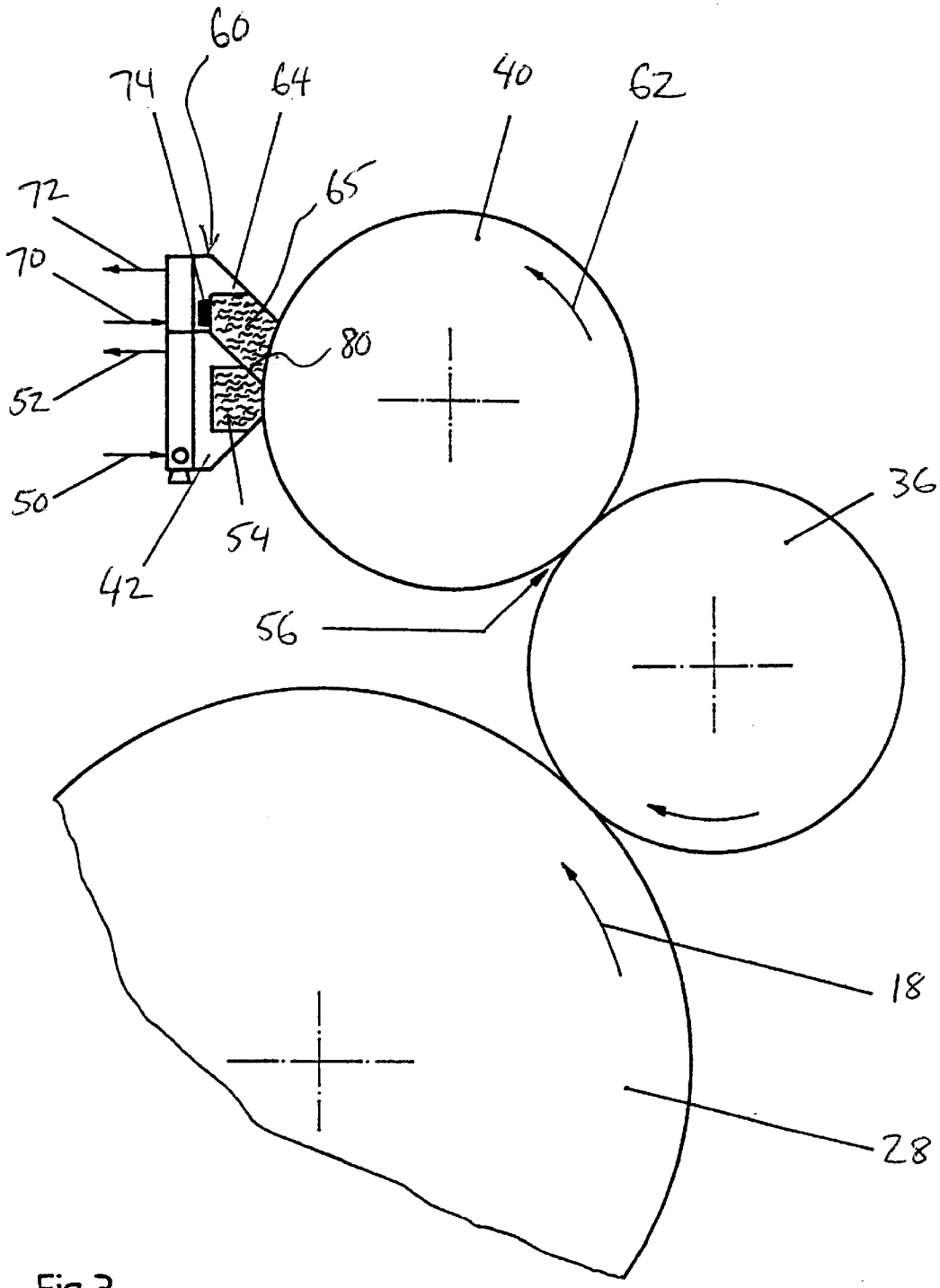
Figure 4:
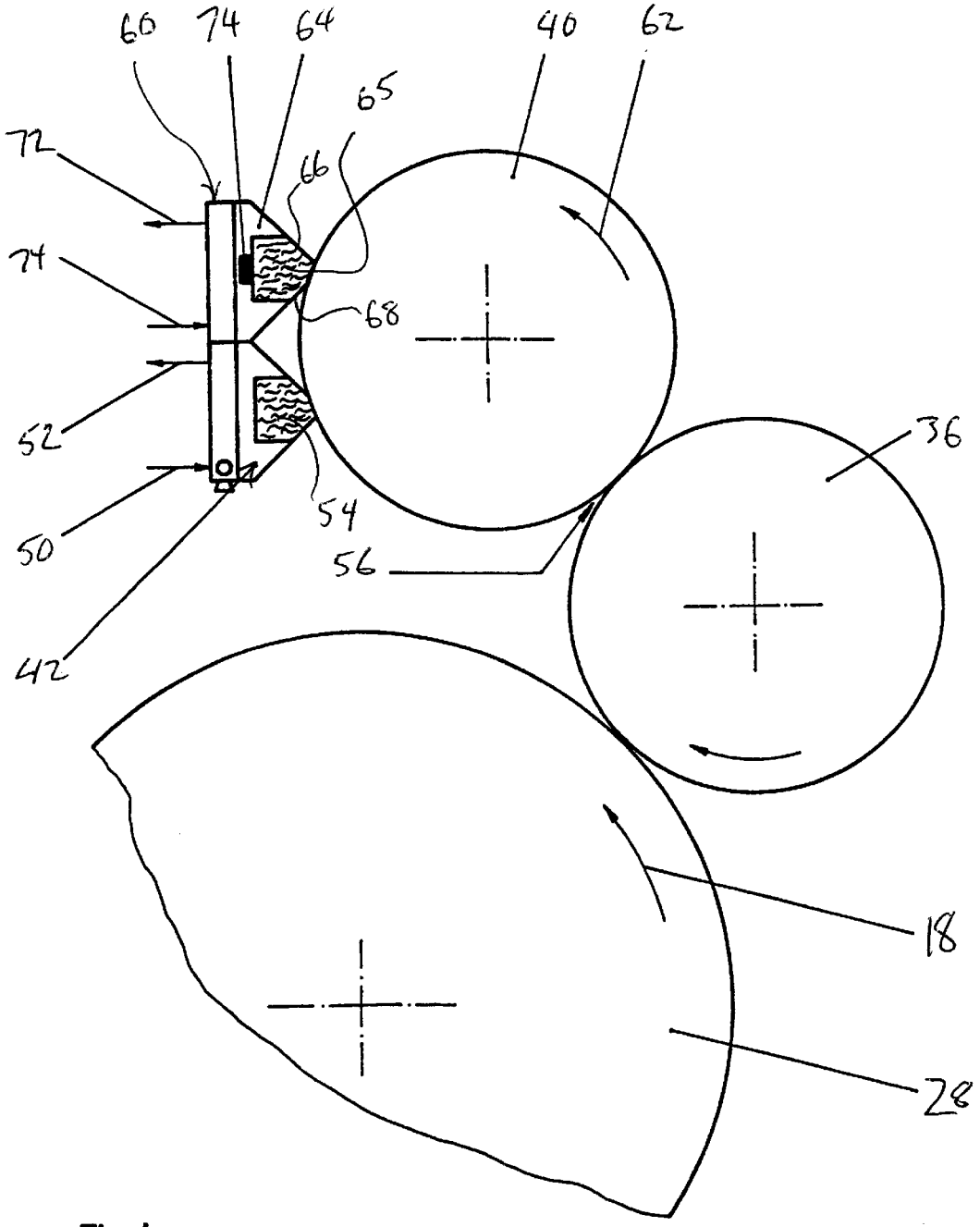
Figure 5:
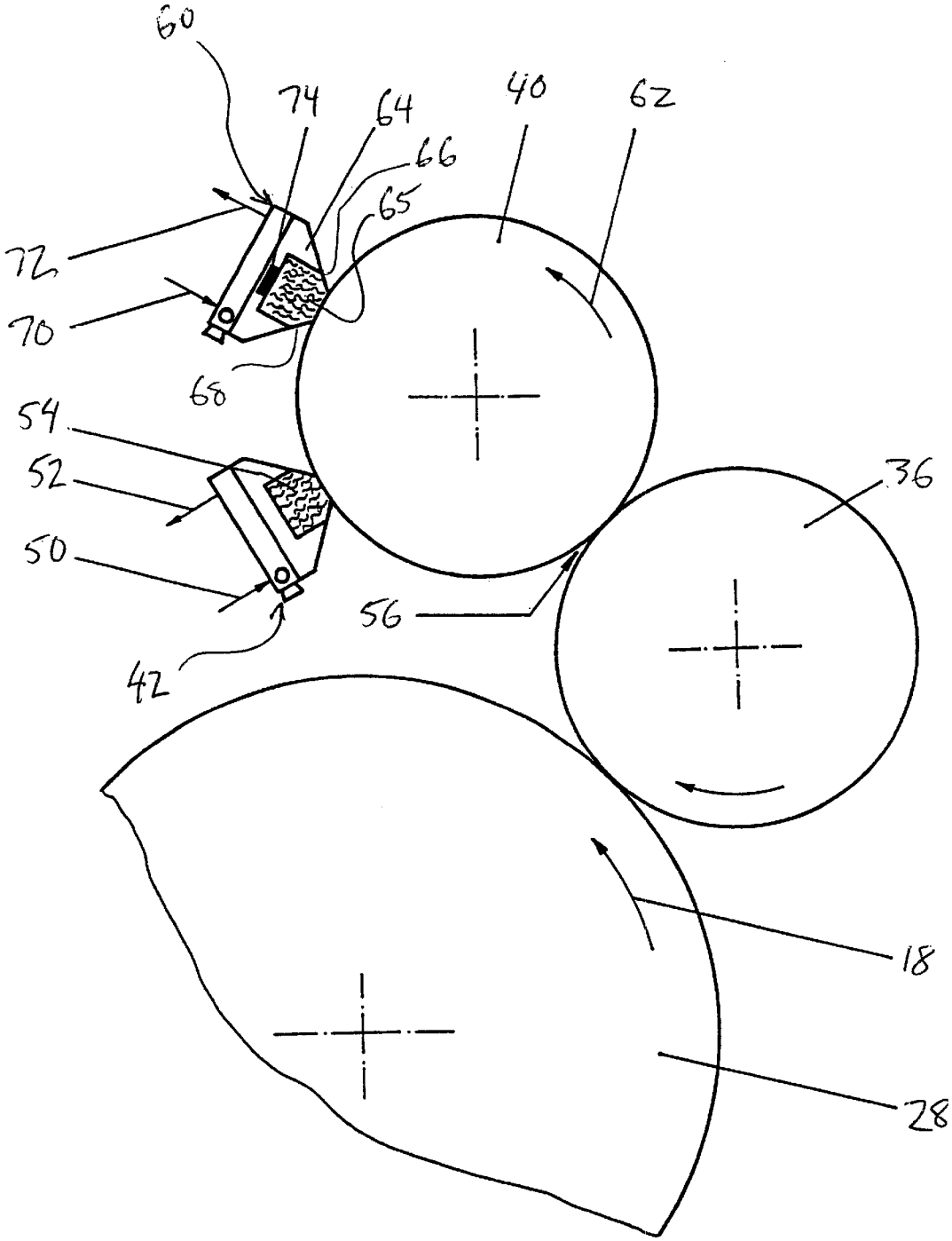

FIGS. 2–5 show various embodiments of the metering system 38 and the cleaning wiper 60. In FIG. 2, the metering system 38 and cleaning wiper 60 are positioned opposite each other relative to an associated applicator roller 40. In FIG. 3, the metering system 38 and cleaning wiper 60 are provided in a combined integrated structure. In FIG. 4, the metering system 38 and cleaning wiper 42 are positioned adjacently to each other. In FIG. 5, the metering system 38 and a cleaning wiper 60 are positioned separately from each at an angle relative to the direction of rotation 62 of the associated applicator roller 40.

To provide operable cleaning, the cleaning wiper 60 includes a housing 64 defining a fluid chamber 65. To provide a sealed window of exposure between the fluid cavity and the surface of the applicator roller 40, the cleaning wiper 60 includes a respective leading blade 66 and a parallel trailing blade 68, as shown in FIGS. 2–5. The leading blade 66 and trailing blade 68 are each detachably mounted to the housing 64 for operable sealed contact against the applicator roller 40. The cleaning wiper 60 has width sufficient to span along the width of the roller 40. Additionally, lateral sealing elements are mounted to the housing 64 to provide sealing of the chamber 65 at ends of the applicator roller 40. Generally, the chamber 65 defined by the leading blade 66 and trailing blade 68 is positionable against the surface of the applicator roller 40 to provide a washing effect.

To deliver a cleaning fluid, for example water, to the chamber 65, the cleaning wiper 60 includes a feed line 70 and a return line 72. Via the feed line 70 and return line 72, cleaning fluid is circulated through the chamber 65. The circulation is operated as needed by a controllable pump system.

For enhanced cleaning effectiveness, a preferred embodiment of the cleaning wiper 60 includes a vibrational driver 74, as also shown in FIG. 2. The vibrational driver 74 directs ultrasonic vibrations through the cleaning wiper 60 toward the surface of the applicator roller 40. The ultrasonic vibrational driver 74 is preferably mounted to the housing 64. During a coating process when the metering system 38 or 38' is active, the ultrasonic vibrational driver 74 may be controllably actuated as desired by the control system.

During the coating process, the cleaning wiper 60 can be brought into and out of contact with the applicator roller 40, for example by means of a rotary joint and a hydraulic or pneumatic cylinder. In an in-contact state, a cleaning fluid can be introduced to the chamber 65 via the feed line 70 and withdrawn from the chamber 65 via the return system 72. If required, the ultrasonic vibrational driver 74 can then be activated. In an embodiment wherein the applicator roller 40 has a smooth surface, the cleaning wiper 60 may be sufficiently effective without assistance of the ultrasonic vibrational driver 74. In an embodiment wherein the applicator roller 40 has an engraved surface, the cleaning wiper 60 is preferably used with the additional ultrasonic vibrational driver 74.

In an integral design, referring again to FIG. 3, the metering wiper 38 includes a metering wiper 42 which is integrally constructed with the cleaning wiper system 60. As shown, the cleaning wiper 60 is positioned upstream of the metering wiper 42 relative to the direction of rotation 62 of the applicator roller 40, yet downstream of the gap 56 or point of contact between the applicator roller 40 and the plate cylinder 36. Advantageously, only a single blade 80 is needed to separate the chambers 54 of the chamber-type metering wiper 42 and cleaning wiper 60, thereby using fewer parts.

If, during the coating process, splitting-back of the ink occurs on the applicator roller 40 or 40' (possibly in the respective metering system) in the respective first or second coating unit 14, 16 (or additional coating units), then the respective cleaning wiper 60 can be activated in the respective coating unit. To prevent the splitting back of the ink, the cleaning fluid circulated through the chamber 65 contacts the surface of the applicator roller 40, partially dissolving the ink from the applicator roller 40, and is carried away. The washed applicator roller 40 then operates in a desirable manner without the splitting back, thereby resulting in consistent, high quality of processing. Depending on the level of contamination and the type of surface of the applicator roller 40, the ultrasonic vibration 74 can be activated to provide enhanced cleaning action. The cleaning process can be carried out continuously or discontinuously, as needed.

In order to prevent residual cleaning fluid entering the metering system 38, a blowing device can be provided to dry the applicator roller 40 by blowing away excess fluid. For example, a blower pipe may be provided which is preferably directed to act over the width of the applicator roller 40, as illustrated in FIG. 2. The blowing device may be arranged between the cleaning wiper 60 and the metering system 38, or the blowing pipe may, in an embodiment, be mounted along the cleaning wiper 60. To further assist in cleaning the applicator roller, in another embodiment, the cleaning wiper 60 can further include one or more cleaning brushes mounted within the chamber 65 and which act against the roller surface.

In an embodiment wherein the metering system 38 has a chamber-type wiper 42 and an engraved applicator roller 40, an ultrasonic vibrator system may be provided to vibrate the chamber-type wiper 42. Preferably, this arrangement is carried out in a similar manner to the ultrasonic vibration system 74 in the cleaning wiper 60. The chamber-type wiper 42 having an ultrasonic drover is an advantage in that the ultrasonic vibrations act, continuously or discontinuously, on the coating medium in the interior chamber 54. The vibrations result in an improved coalescence of microscopic foam bubbles which are produced, inter alia, by air moving from emptied recesses and dimples in the engraved applicator roller 40 into the interior 54 of the metering wiper 42. Larger gas bubbles formed in this way can be removed from the chamber 54. Otherwise, the larger gas bubbles float up more rapidly than the microscopic foam bubbles in the chamber 54. With the removal of the gas bubbles, the coating process has increased effectiveness, and the quality is stabilized.

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

What is claimed is:

1. A sheet-fed rotary printing machine comprising a plurality of printing units for multicolor printing and at least one coating unit, each coating unit being arranged downstream of the printing units relative to a sheet conveying direction, each of the coating units including a sheet-carrying cylinder, a plate cylinder in rolling contact with the sheet-carrying cylinder, an applicator roller for coating the plate cylinder, a metering system for applying a coating fluid to the applicator roller, and a cleaning wiper is arranged upstream of the metering system relative to a direction of rotation of the applicator roller to remove residual matter from the applicator roller.

2. The rotary printing machine according to claim 1, wherein the cleaning wiper includes a housing defining a chamber, a leading blade and a trailing blade mounted to the housing and defining an opening to the chamber, the blades sealably contacting the applicator roller.

3. The rotary printing machine according to claim 2, further comprising an ultrasonic vibrational driver mounted to the housing of the cleaning wiper to direct sound vibrations toward the surface of the applicator roller.

4. The rotary printing machine according to claim 3, wherein the ultrasonic vibration system is selectively operable during the coating process.

5. The rotary printing machine according to claim 1, wherein the cleaning wiper system is movably brought into or out of contact with the applicator roller during the coating process.

6. The rotary printing machine according to claim 1, further comprising a conduit system including a feed line for delivering cleaning fluid to the cleaning wiper and a return line for withdrawing the cleaning fluid from the cleaning wiper.

7. A printing machine comprising:

a plurality of sheet carrying drum cylinders to transport sheets in a conveying direction;

at least one printing unit for printing the sheets; and at least one coating unit positioned downstream of the printing unit relative to the conveying direction for applying a coating to the sheets, each of the coating units including:

a plate cylinder positioned to act upon the transported sheets;

an applicator roller operable to apply a coating to the plate cylinder;

a metering system for applying coating fluid to the applicator roller; and a cleaning wiper mounted upstream of the metering system relative to a direction of rotation of the applicator roller to clean the applicator roller.

8. The printing machine of claim 7, wherein the metering system includes a metering wiper having a housing defining a chamber and a pair of blades mounted along an opening of the chamber, and a fluid conduit system for delivering coating fluid to the chamber, the blades contacting the applicator roller so that the fluid in the chamber contacts the applicator roller.

9. The printing machine of claim 7, wherein the cleaning wiper includes a housing defining a chamber, a fluid conduit system for circulating cleaning fluid through the chamber, a pair of blades mounted along an opening of the chamber for sealable contact against the applicator roller to permit contact of the cleaning fluid in the chamber against the applicator roller.

10. The printing machine of claim 9, further comprising a vibrational driver mounted to the housing to direct vibration toward the applicator roller.

11. The printing machine of claim 10, wherein the vibrational driver operates at an ultrasonic frequency.

12. The printing machine of claim 7 wherein the cleaning wiper is mounted to contact the applicator roller approximately 180 degrees from the metering system.

13. The printing machine of claim 7, wherein the cleaning wiper is mounted adjacently to the metering system.

14. The printing machine of claim 7, wherein the metering system is integrally constructed with the cleaning wiper such that the metering system includes a housing defining a metering chamber, the cleaning system includes a housing defining a cleaning fluid chamber, wherein the metering chamber and cleaning fluid chamber are separated by a common blade that contacts the applicator roller.

15. The printing machine of claim 7, further comprising a blower device acting to blow away residual fluid on the applicator roller between the cleaning wiper and the metering system.

16. The printing machine of claim 7, comprising multiple said coating units.

* * * * *